US005572822A

United States Patent [19]

Lynch et al.

[11] Patent Number: 5,572,822

[45] Date of Patent: Nov. 12, 1996

[54] PRODUCT IDENTIFICATION AND EXHIBITING SYSTEM

[75] Inventors: Carol A. Lynch, Farmingdale; Kurt L. Haverkost, Mt. Kisco, both of N.Y.

[73] Assignee: Leviton Manufacturing Co., Inc., Little Neck, N.Y.

[21] Appl. No.: 287,578

[22] Filed: Aug. 9, 1994

[51] Int. Cl.[6] ..... G09F 3/18

[52] U.S. Cl. ..... 40/642; 40/308

[58] Field of Search ..... 40/308, 642, 649, 40/657, 658, 620, 622; 211/86, 94, 106

[56] References Cited

U.S. PATENT DOCUMENTS

| | | | |
|---|---|---|---|
| 2,125,437 | 8/1938 | Geary | 40/620 X |
| 4,094,415 | 6/1978 | Larson . | |
| 4,461,443 | 7/1984 | Dauman . | |
| 4,607,753 | 8/1986 | Radek . | |
| 4,771,897 | 9/1988 | Ho . | |
| 4,791,739 | 12/1988 | Hetzer | 40/622 X |
| 4,922,639 | 5/1990 | Rehrig | 40/642 X |
| 5,148,925 | 9/1992 | Althoff et al. . | |
| 5,228,579 | 7/1993 | Kaufman . | |
| 5,428,914 | 7/1995 | Whitehouse et al. | 40/657 X |

*Primary Examiner*—Brian K. Green
*Attorney, Agent, or Firm*—Paul J. Sutton

[57] ABSTRACT

A product identification and exhibiting system for bulk items placed in bins with or without individual packaging or identification, items which are carded and hung on display arms, or placed upon display shelves. A base member is attached to a number of aligned bins and upon said base member is placed a display member or the combination of a display member and display hub. The items in each bin are identified by a placard mounted upon the base member and by a representative sample mounted upon the display member-display hub combination.

16 Claims, 7 Drawing Sheets

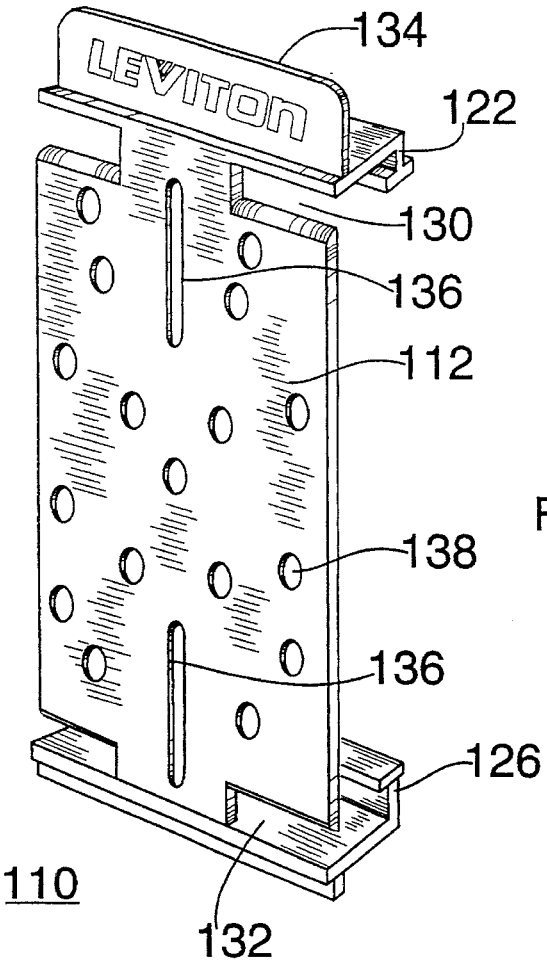
Fig. 6
FIG. 7
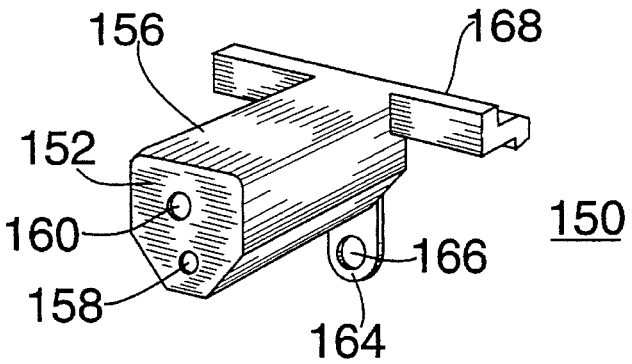
FIG. 8
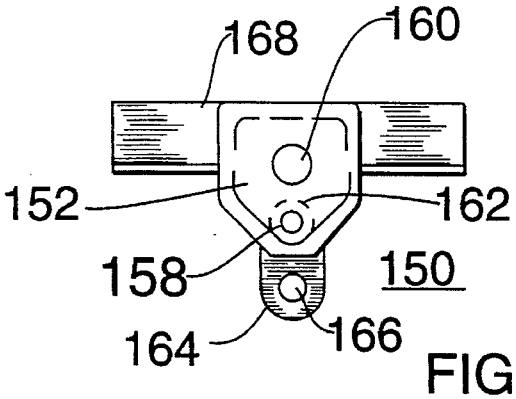
FIG. 9

PRODUCT IDENTIFICATION AND EXHIBITING SYSTEM

BACKGROUND OF THE INVENTION

1. Field of the Invention

The invention is directed to the field of product merchandising and more particularly to bulk merchandising where the individual product may or may not be marked with product information or packed with such information.

2. Description of the Prior Art

Until recently small items, for example, electrical switches, receptacles, plugs and the like were individually boxed or blister packaged with pertinent information about the product on the packaging or on a stuffer sheet packed with the product. This made for additional cost due to the extra handling and the packaging materials and time required. It was found that with such fungible goods as electrical switches, receptacles, plugs and the like many users did not need the product and use information and would prefer the lower cost of unpackaged products although some still preferred the items in bags or boxes with installation instructions or other useful information thereon.

The unpackaged goods were put into wire bins or baskets mounted on display racks. An identification device with the product name, catalog number and price was hung on the top, front edge of the bin but this device was often displaced from the bin. Identification devices could be attached to the front wall of the bin, but they were difficult to read if on a lower bin. Also these devices were difficult to change and partly obscured the products in the bin. Potential customers often reached into the bin took a product out to identify it and returned it often to the wrong bin or in such a manner as to damage the product.

The U.S. patents to Damman, U.S. Pat. No. 4,461,443 issued Jan. 24, 1984; Radik, U.S. Pat. No. 4,507,753 issued Aug. 26, 1986; Althoff et al, U.S. Pat. No. 5,148,925 issued Sep. 22, 1992 and Kaufman, U.S. Pat. No. 5,228,579 issued Jul. 20, 1993 all show complex wall mounting systems to display goods but do not describe devices for bulk merchandising of goods.

Larson, U.S. Pat. No. 4,094,415 issued Jun. 13, 1978 shows mounting and display devices which require the individual devices to be packaged and individually hung from hooks.

The patent to Ho, U.S. Pat. No. 4,771,897 issued Sep. 20, 1988 requires that the keys hung from his rack require special identification boards.

SUMMARY OF THE INVENTION

The present invention overcomes the complex wall rack requirements and eliminates the need for individually packaged goods while permitting the continued use of wire baskets to contain the goods and display racks on which the wire baskets or bins are hung. The present invention also permits the display of packaged goods where the packaging is needed to provide identification of the goods their ratings, wiring diagrams or to have a place for UPC coding.

The present invention comprises a base member which is attached to the top and bottom rails of one or more wire bins. On its front face it has channels to accept product identification and information printed on cards and permit their placement anywhere along the face of the base member. A display member is fitted into channels in the base member top and bottom edges so that it can also be placed along the base member. A plurality of apertures are provided to accept various fastening means to anchor a product to such display member. A further, display hub, can be attached to said display member to permit the attachment thereto of products which, due to their shape or size, require separation from the display member. Finally, a hinged flap with channels along its top and bottom edges can be used to display further product information such as the price of the product in the adjacent bin. It is an object of this invention to provide a novel product identification and exhibiting system.

It is an object of this invention to provide a novel product identification and exhibiting system for products merchandised in bulk, carded, in baskets or on shelves.

It is yet another object of this invention to provide a novel product identification and exhibiting system where each type of product is placed in individual bins.

It is still another object to provide a novel product identification and exhibiting system which displays the product located in each bin and provides information with respect to such product.

Other objects and features of the invention will be pointed out in the following description and claims and illustrated in the accompanying drawings, which disclose, by way of example, the principles of the invention and the best modes which are presently contemplated for carrying them out.

BRIEF DESCRIPTION OF THE DRAWINGS

In the drawings in which similar elements are given similar reference characters:

FIG. 7 is a front, right perspective view of the display member of FIGS. 5 and 6.

FIG. 8 is a front, right perspective view of a display hub according to the concepts of the invention.

FIG. 9 is a front elevational view of the display hub of FIG. 8.

DESCRIPTION OF THE PREFERRED EMBODIMENT

Figure 1:
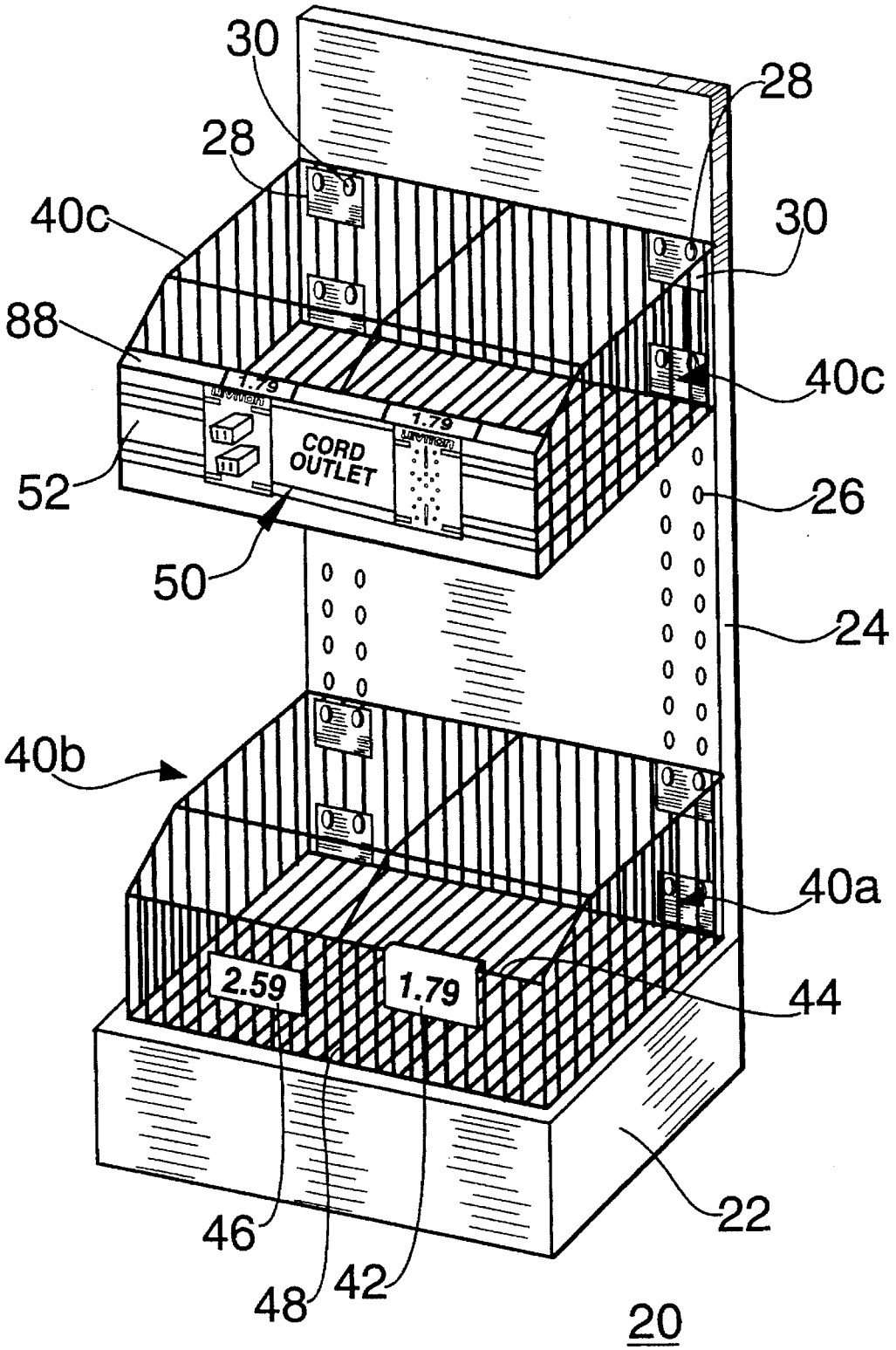
FIG. 1 is a right, front prospective view of a display rack with product bins mounted thereto and showing bins marked according to the prior art and according to the concepts of the invention.

Turning now to FIG. 1 there is shown a rack system 20 for supporting a number of wire baskets or bins 40. Rack system 20 has a base 22 to which is attached an upstanding wall 24, containing a number of apertures 26. The individual baskets 40 are hung on wall 24 using metal plates 28 at each of the four corners of the bin back wall with screws 30 passing through plates 28 into the apertures 26. Any other suitable mounting means may be employed to mount baskets 40 on wall 24.

The contents of wire basket or bin 40*a* is identified and priced by a plate 42 which has a channel (not shown) which fits over the top wire 44 of the front wall of bin 40*a*. The plate 42 is difficult to read if on a lower bin, obscures the bin content and often gets knocked into the bin by a person reaching into the bin.

A somewhat more permanent plate 46 is attached to some of the verticle wires 48 of bin 40*b*. It is also difficult to read on lower bins, covers a portion of the bin 40*b* and is difficult to remove to change the information on it.

Bins 40*c* are marked with the product identification and exhibiting system 50 of the instant invention. Although it obscures the front wall of each bin 40*c*, it clearly presents to the purchaser exactly what is in the bin and tells him the price of the item. From the merchants point of view he can quickly change the item displayed, the product information and the price. This information is readily available regardless of the position of the bin 40 on wall 24.

Figure 2:
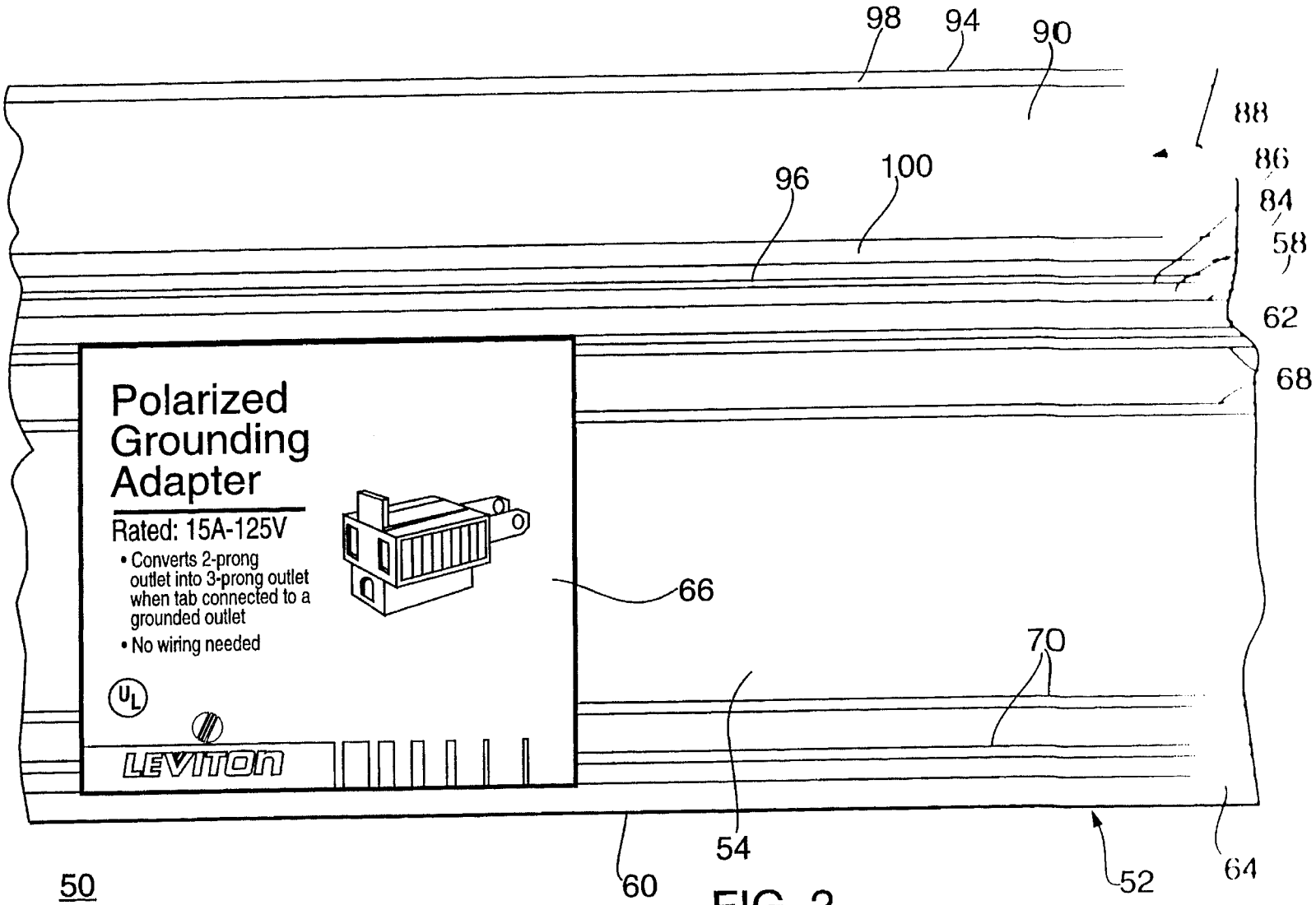
FIG. 2 is a fragmentary front elevational view of the base member of the instant invention with a product placard shown in position on the base member.
Figure 3:
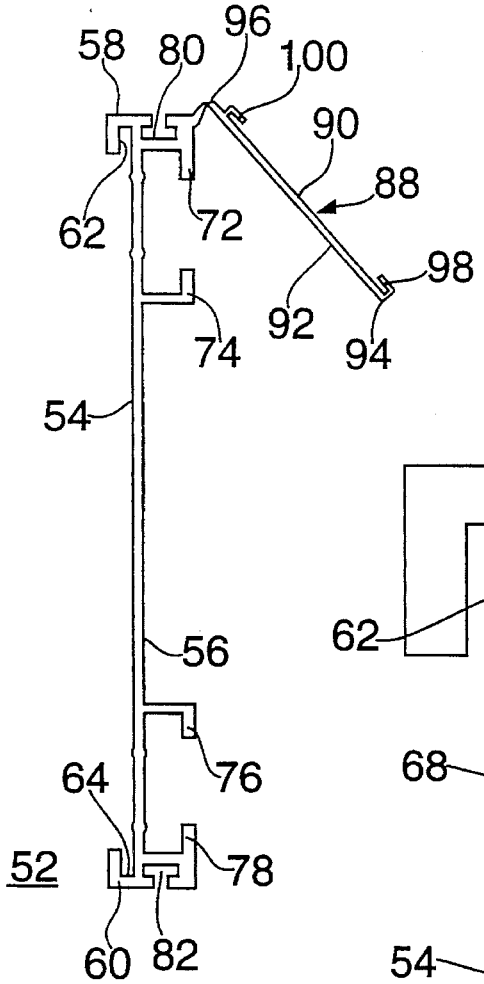
FIG. 3 is a side elevational view of the base member of FIG. 2.
Figure 4:
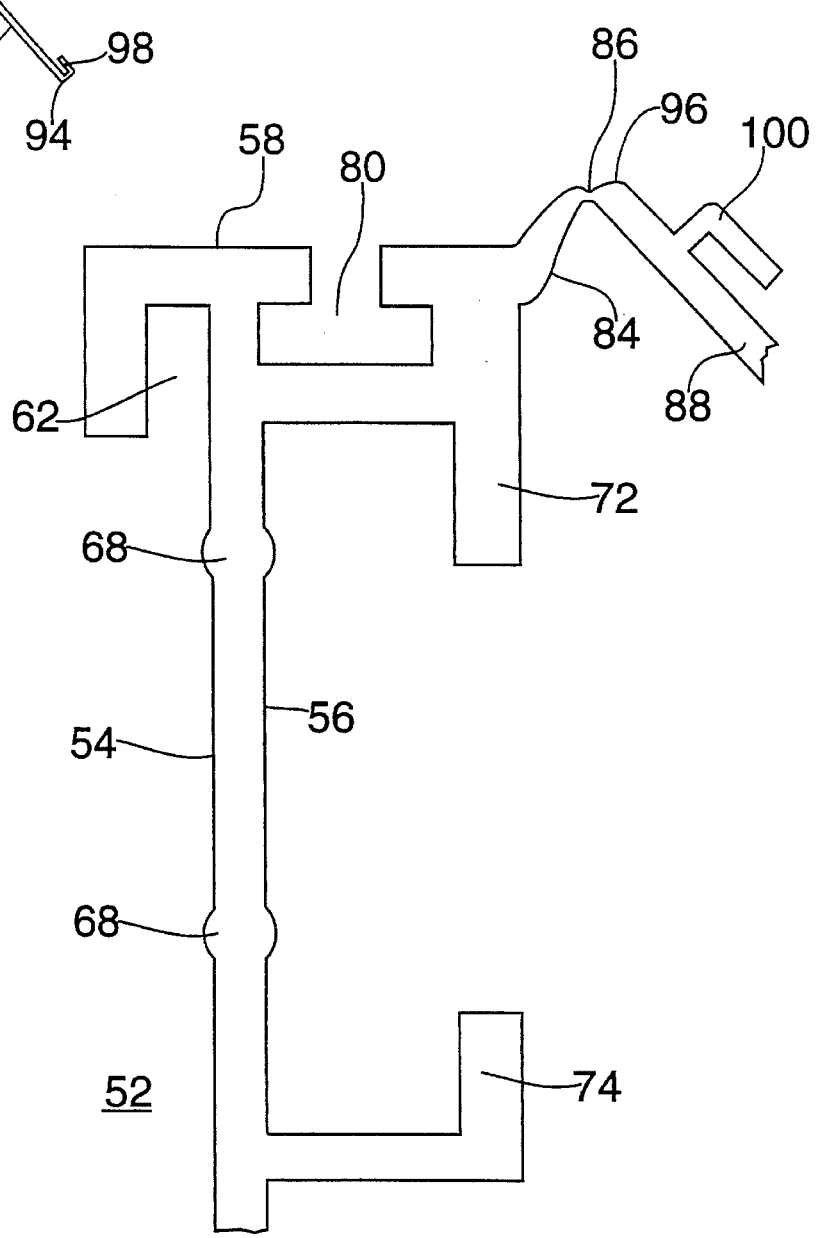
FIG. 4 is an enlarged fragmentary, side elevational of the top portion of the base member of FIG. 3.

Reference is now made to FIGS. 2, 3 and 4 which show the base member 52 of the product identification and exhibiting system 50. Base member 52 is a plastic extrusion having a front face 54, a rear face 56, a top edge 58 and a bottom edge 60. Adjacent top edge 58 is L-shaped channel 62 opening towards bottom edge 60. Similarly, adjacent bottom edge 60 is an L-shaped channel 64 opening towards top edge 58. A placard 66 is positioned across front face 54 with its top and bottom edges positioned within channels 62 and 64, respectively. A pair of rails 68 are positioned adjacent channel 62 and a similar pair of rails 70 are positioned adjacent channel 64. Rails 68 and 70 hold placard 66 away from the front face 54 of base member 52 and thus make it easier to slide placard 66 along the base member 52 by decreasing the friction between placard 66 and front face 54.

A pair of L-shaped member 72, 74 opening towards one another project from the rear face 56 of base member 52 adjacent the top edge 58 and a similar pair of L-shaped members 76, 78 opening towards one another project from the rear face 56 adjacent the bottom edge 58. Members 72 and 78 engage the top and bottom wires, respectively, of the front face of the bin 40. In the event that the top and bottom edges of bin 40 have flat marker strips formed thereon (not shown). Members 72 and 74 will grip the top marker strip and members 76 and 78 will grip the bottom marker strip to secure base member 52 to the bin.

A T-shaped recess 80 is formed on rear face 56 adjacent top edge 58 and a similar T-shaped recess 82 is formed on rear face 56 adjacent bottom edge 60. T-shaped recesses 80 and 82 will receive corresponding T-shaped projections of display member 110 as will be described in greater detail below.

Extension 84 of L-shaped member 72 is connected by a living hinge 86, which entends the entire length of base member 52, to a flap 88. Flap 88 has a front face 90, a rear face 92, a top edge 94 and a bottom edge 96. An L-shaped member 98 extends from front face 90 adjacent top edge 94 opening towards bottom edge 96 and a similar L-shaped member 100 extends from front face 90 adjacent bottom edge 96 opening towards top edge 94. Further product information, or the product price may be placed on an additional placard (not shown) and the top and bottom edges of such placard positioned between and under L-shaped members 98 and 100. In use the flap 88 is positioned atop a portion of the inclined side walls of bins 40*c* as shown in FIG. 1. If flap 88 is not to be used it can be folded over the top edge of the font wall of bin 40*c*.

Figure 5:
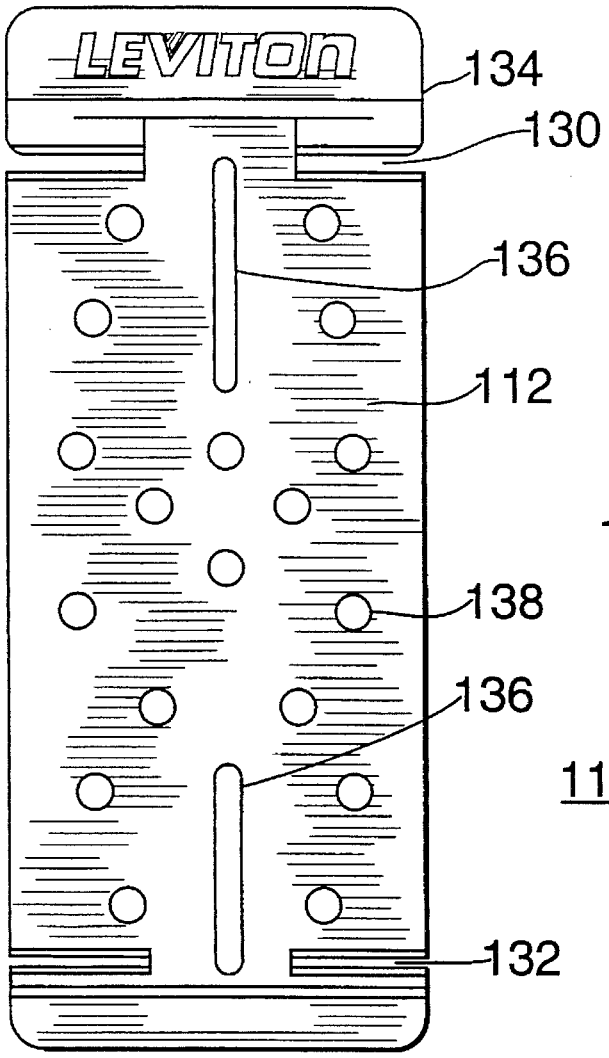
FIG. 5 is a top plan view of a display member according to the concepts of the invention.

To mount products for exhibition on the base member 52 it is first necessary to mount the product directly on a display member 110 or indirectly by use of a display hub coupled to a display member as will be described below. Display member 110 is shown on FIGS. 5, 6 and 7 to which reference is now made. Display member 110 has a front face 112, a rear face 114, a top edge 116 and a bottom edge 118. Extending from and perpendicular to rear face 114 adjacent top edge 116 is an extension 120 which terminates in a T-shaped member 122. A similar extension 124 adjacent bottom edge 118 also terminated in a T-shaped member 126. T-shaped member 122 of display member 110 is positionable in and movable along the T-shaped recess 80 while T-shaped member 126 is positionable in and movable along the T-shaped recess 82. The T-shaped members 122, 126 are placed in the T-shaped recess 80, 82, respectively at one of the open ends of the base member 52 and then slid along the recesses 80, 82 until the display member 110 is in its desired position.

Figure 6:
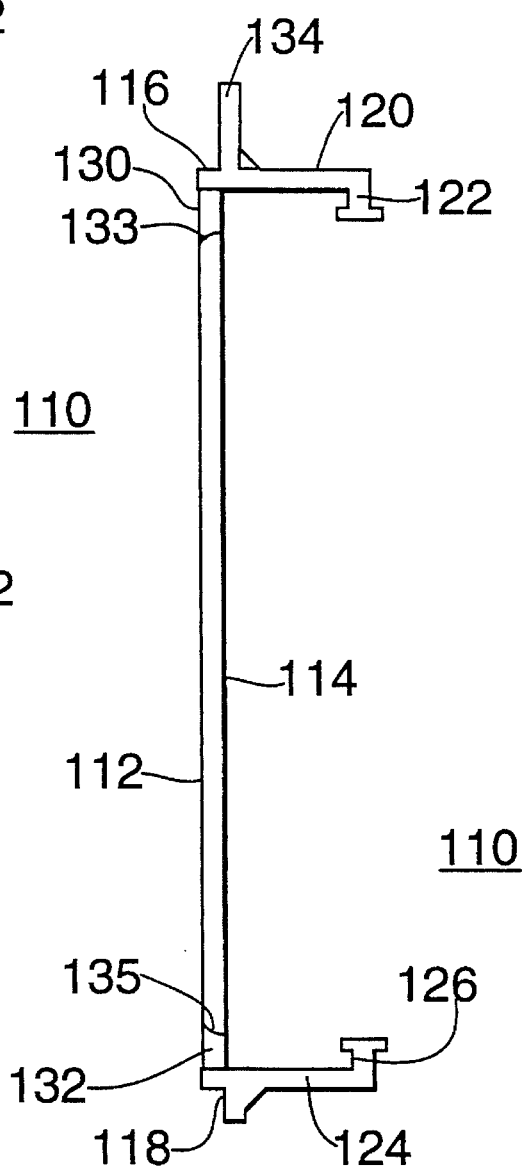
FIG. 6 is a side elevational view of the display member of FIG. 5.
Figure 10:
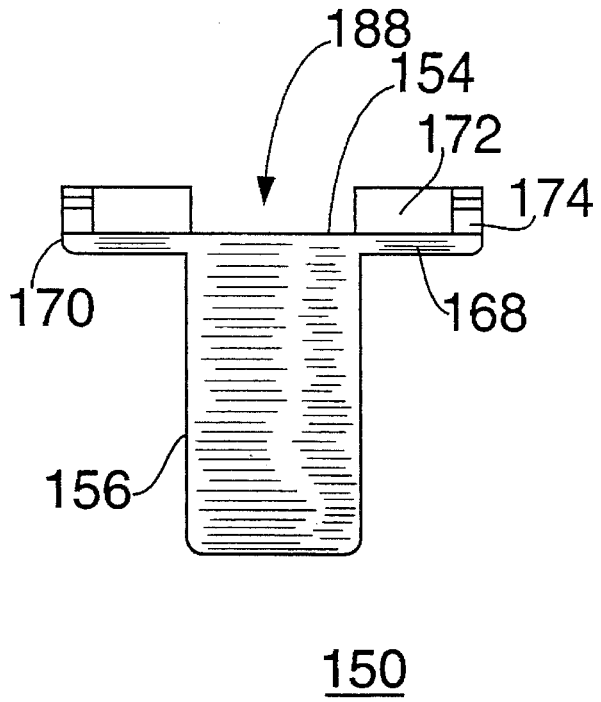
FIG. 10 is a top plan view of the display hub of FIG. 8.
Figure 11:
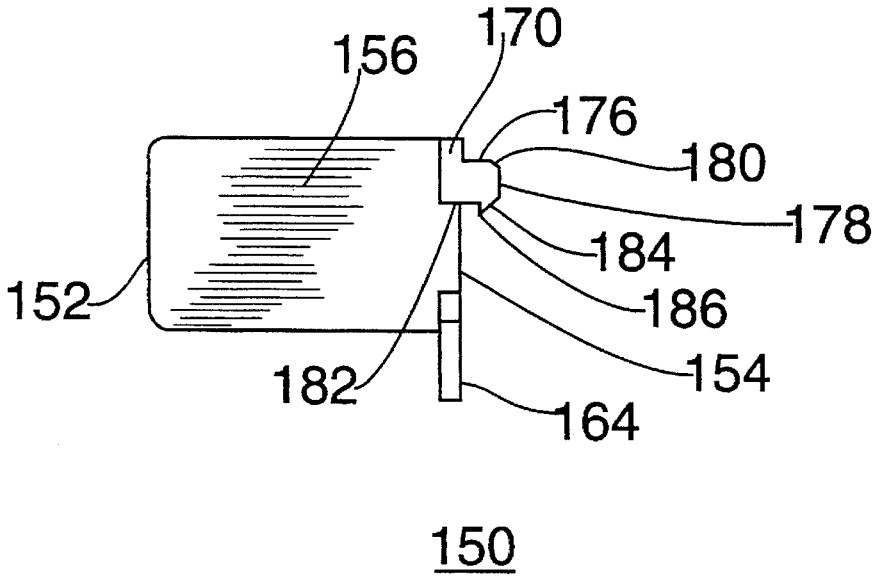
FIG. 11 is a side elevational view of the display hub of FIG. 8.

Slots 130 are placed in display member 110 adjacent top edge 116 and extending towards the center from the marginal edges of member 110. Similar slots 132 adjacent bottom edge 118 also extend towards the center from the marginal edges. As best seen in FIG. 6, the top surface of slot 130 and the bottom surface of slot 132 are perpendicular to front face 112. The bottom surface 133 of slot 130 is upwardly inclined from front face 112 to rear face 114, while the top surface 135 of slot 132 is downwardly inclined from front face 112 to rear face 114. A plate 134 extends from top edge 116 and may be inscribed with a company logo or the like.

Figure 12:
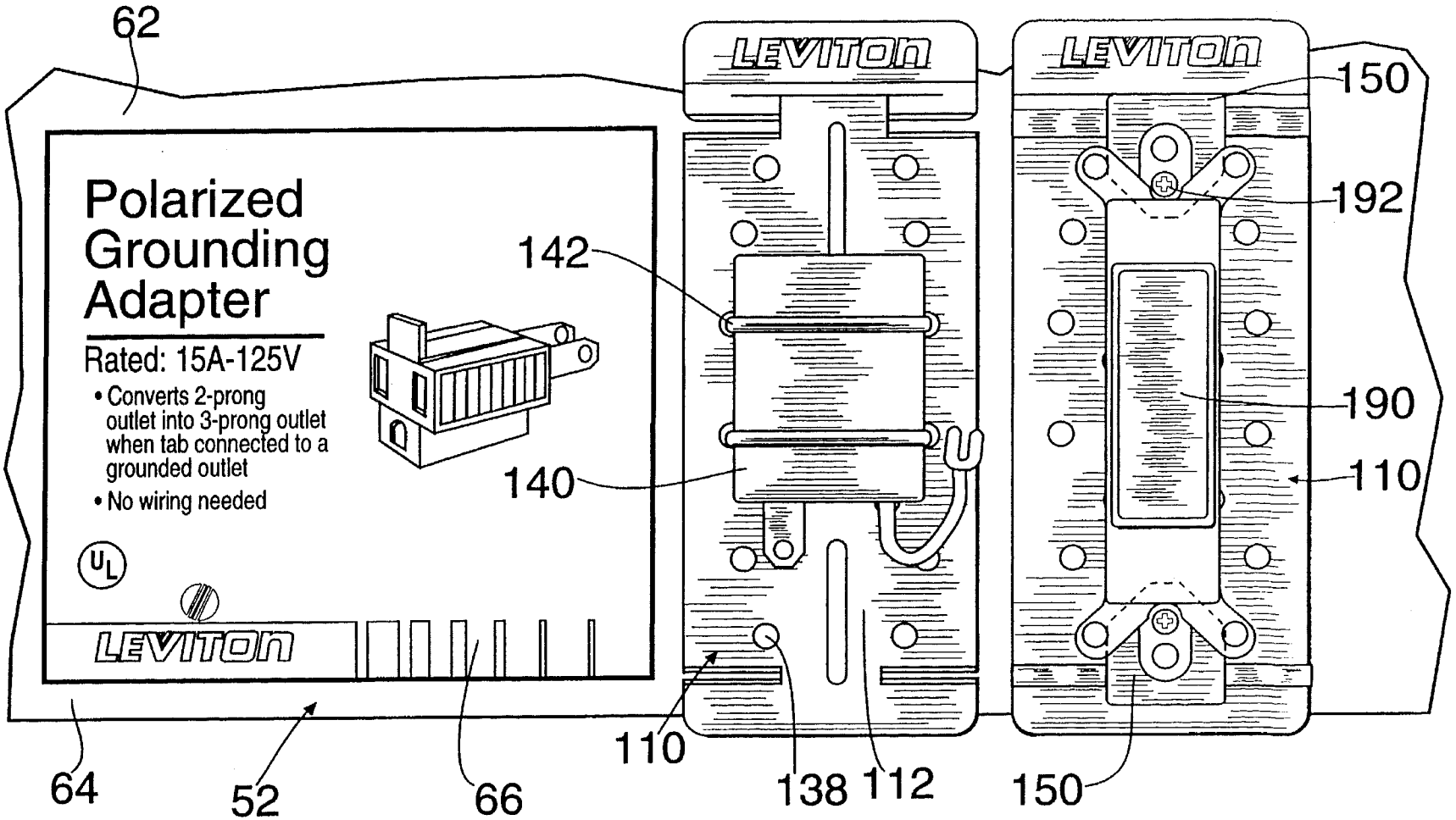
FIG. 12 is fragmentary, front elevational view of the base member of FIG. 2 with a display member and display hub installed.

A pair of long slots 136 extend along a portion of the longitudinal axis of and through display member 110. A pattern of apertures 138 also extends through the member 110 from front face 112 to rear face 114. Various cords, wires, bundling straps, metal rings and the like can be threaded through apertures 138 and slots 136 to fasten objects to the front face 112 of member 110. For example, a polarized grounding adapter 140 can be fastened to the front face 112 of member 110 using metal rings 142 which pass through apertures 138, about adapter 140 and are fastened behind member 110 as is shown in FIG. 12.

With devices normally attached to the ears of a gang box mounted in a wall, a display hub 150 as shown in FIGS. 8, 9, 10 and 11 can be added to the display member 110. Display hub 150 has a front face 152 and a rear face 154 and the body portion 156 therebetween in generally hollow. Front face 152 has two apertures therethrough, a small diameter lower aperature 158 and a larger diameter upper aperature 160. As shown in FIG. 9, the aperture 158 has a boss 162 about it (shown in dashed line) to permit receipt of a self-taping screw to anchor a wiring device to the display hub 150. A tab 164 extends from body 156 and contains an aperature 166 which is aligned with a slot 136 of display member 110.

Extending across the back face 154 of hub 150 is cross-member 168. At the ends 170 of cross-member 168 are outwardly extending members 172 each of which terminate in an enlarged section 174. The enlarged section 174 has a flat top surface 176 perpendicular to rear face 154 and a back surface 178 parallel to rear face 154 with an inclined surface 180 between surfaces 176 and 178. Enlarged section 174 has a bottom surface 182 and an inclined face 184 between bottom surface 182 and back surface 178. Surface 182 is undercut to provide a rib 186 along the length of extending members 172. Extending members 172 are wide enough to engage slots 130, 132 in member 110 and are separated by a gap 188 which is aligned with the region between each of the slots 130, 132.

To mount the display hub 150 on the display member 110, the members 172 are aligned with a pair of slots 130 or 132. The hub 150 is then pushed in a direction perpendicular to the font face 112. The inclined surfaces 184 of members 172 press upon inclined surface 133 and 135 of slots 130, 132, respectively, expanding the slots 130, 132 to permit rib 186 to pass through the slot, after which the slots 130, 132 return to their normal size. Rib 186 is now in engagement with the rear face 114 of the display member 110 to prevent separation of the display hub 150 from the display member 110.

As shown in FIG. 12, a display member 110 is affixed to base member 52 as described above and two display hubs 150 are attached to display member 110 as above described. A rocker switch 190 is positioned between hubs 150 with the mounting holes aligned with apertures 158. A self-taping screw 192 is used to fasten the rocker switch 190 to the display hubs 150.

While there have been shown and described and pointed out the fundamental novel features of the invention as applied to the preferred embodiment, it will be understood that various omissions and substitutions and changes of the form and details of the devices illustrated and in their operation may be made by those skilled in the art, without departing from the spirit of the invention.

The embodiments in which an exclusive property or privilege is claimed are defined as follows:

1. A product identification and exhibiting system for products contained in bins, comprising:

a) a base member having a first end, a second end, a top edge and a bottom edge together defining a geometrical shape, said base member having means to attach said base member to a bin containing products, said base member having first track means adjacent said top edge and second track means adjacent said bottom edge between said first end and said second end to attach a display member to said base member;

b) a display member having a top edge and a bottom edge to support and exhibit a representative sample of the products in the bin, said display member having first rail means adjacent said display member top edge and second rail means adjacent said display member bottom edge to engage, respectively, with said base member first track means adjacent said top edge and said base member second track means adjacent said bottom edge to permit said display member to be selectively moved along said first and second track means adjacent, respectively, said top edge and said bottom edge of said base member and be aligned with its associated bin; and c) a plurality of apertures in said display member to receive fastening means therein to secure a representative sample to said display member.

2. A product identification and exhibiting system as defined in claim 1, wherein said apertures in said display member comprise circular apertures and elongated slots.

3. A product identification and exhibiting system as defined in claim 1, wherein said base member has a front face and a rear face;

said front face having rib means adjacent said top and said bottom edges for receipt therebetween of placards containing information pertaining to the product in an associated bin.

4. A product identification and exhibiting system as defined in claim 3, further comprising additional rib means extending across said front face of said base member parallel with said top and bottom edges, said additional rib means for engaging a rear face of placards placed between said rib means adjacent said top edge and said rib means adjacent said bottom edge to facilitate the movement of the placards along said base member.

5. A product identification and exhibiting system as defined in claim 3, further comprising:

a flap member having a front face, a rear face, a top edge and a bottom edge, said flap member hingedly coupled at its bottom edge to said base member adjacent its top edge.

6. A product identification and exhibiting system as defined in claim 5, wherein said front face of said flap member has additional rib means adjacent said top and bottom edges for the receipt therebetween of additional placards containing additional information pertaining to the products in an associated bin.

7. A product identification and exhibiting system as defined in claim 6, wherein said flap member is selectively positionable with respect to said base member from a first position where it would engage the bin upon which said base member is placed to display additional placards placed on said flap member to a second position adjacent said base member rear face where said flap member is not visible.

8. A product identification and exhibiting system as defined in claim 3, wherein said base member first track means adjacent said top edge extends from said rear face of said base member and said second track means adjacent said bottom edge extends from said rear face of said base member;

said display member having a front face and a rear face; said first rail means extending from said display member rear face; and said second rail means extending from said display member rear face whereby said display member is capable of being moved along said front face of said base member.

9. A product identification and exhibiting system as defined in claim 8, wherein said first track means and said top rail means have complementary cross-sections; and said second track means and said bottom rail means have complementary cross-sections;

whereby said display member can be non-removably moved along said front face of said base member.

10. A product identification and exhibiting system as defined in claim 3, said base member having further rib means, adjacent said top edge and said bottom edge extending from said rear face of said base member for attachment of said base member to an associated bin.

11. A product identification and exhibiting system as defined in claim 10, wherein each of said further rib means comprises:

a) a pair of parallel ribs, each rib of said pair of parallel ribs having a first end and a second end, each of said ribs of said pair of parallel ribs parallel with and spaced apart from each other and said rear face of said base member;

b) said second end of one rib of said pair of parallel ribs facing the second end of the other rib of said pair of parallel ribs to permit said base member to be mounted on a bin.

12. A product identification and exhibiting system as defined in claim 1, further comprising:

at least one attachment hub adapted to be mounted upon said display member to support and exhibit a representative sample of the products in the bin.

13. A product identification and exhibiting system defined in claim 12, wherein said display member has a front face, a rear face;

said at least one attachment hub has a front face and a rear face, said rear face of said at least one attachment hub being spaced from said rear face of said at least one attachment hub to support a product sample above said front face of said display member.

14. A product identification and exhibiting system as defined in claim 13, wherein said front face of said at least one attachment hub includes at least one aperture to receive a fastener to fix a product to said at least one attachment hub.

15. A product identification and exhibiting system as defined in claim 13, wherein said at least one attachment hub includes two attachment hubs, one adjacent said top edge of said display member and the other adjacent said bottom edge of said display member;

said front face of each of said two attachment hubs having at least one aperture to receive a fastener to fix a product sample between said two attachment hubs and above said front face of said display member.

16. A product identification and exhibiting system as defined in claim 12, wherein said at least one attachment hub further comprises locking rib means and said display member has complementary slots;

said at least one attachment hub being locked to said display means by the engagement of said at least one attachment hub locking rib means with said complementary slots in said display member.

* * * * *